United States Patent [19]

Schanz et al.

[11] Patent Number: 4,545,532

[45] Date of Patent: Oct. 8, 1985

[54] ADJUSTABLE OSCILLATING FAN-JET SPRINKLER

[75] Inventors: Friedrich Schanz; Emil Schucker, both of Calw; Alexander Perrot, Althengstett, all of Fed. Rep. of Germany

[73] Assignee: Perrot-Regnerbau GmbH & Co., Calw, Fed. Rep. of Germany

[21] Appl. No.: 381,948

[22] Filed: May 26, 1982

[30] Foreign Application Priority Data

May 29, 1981 [DE] Fed. Rep. of Germany ..... 3121369

[51] Int. Cl.[4] ..... B05B 3/16

[52] U.S. Cl. ..... 239/242; 239/265

[58] Field of Search ..... 239/237, 240, 242, 265, 239/DIG. 1

[56] References Cited

U.S. PATENT DOCUMENTS

| | | | |
|---|---|---|---|
| 2,546,241 | 3/1951 | Squiers | 239/242 |
| 2,934,973 | 5/1960 | Smith | 239/237 |
| 2,952,413 | 9/1960 | Jepson | 239/237 |
| 3,047,241 | 7/1962 | McLhwney | 239/242 |
| 3,269,661 | 8/1966 | Thompson | 239/242 |
| 3,332,624 | 7/1967 | Rinkewich | 239/242 |
| 3,567,122 | 3/1971 | Congdon | 239/242 |
| 3,578,248 | 5/1971 | Congdon | 239/242 |

*Primary Examiner*—Andres Kashnikow
*Assistant Examiner*—James R. Moon, Jr.
*Attorney, Agent, or Firm*—Joseph A. Geiger

[57] ABSTRACT

A fan-jet sprinkler of the type which has an oscillating horizontal nozzle cylinder driven by a turbine wheel and a translation drive, the sprinkler having a rotational connection between its stand and housing, or between the nozzle cylinder and an oscillating drive sleeve, so that the oscillation range can be shifted by adjusting the angular relationship between the oscillation range and the sprinkler stand independently of the drive transmission.

7 Claims, 8 Drawing Figures

Fig. 3
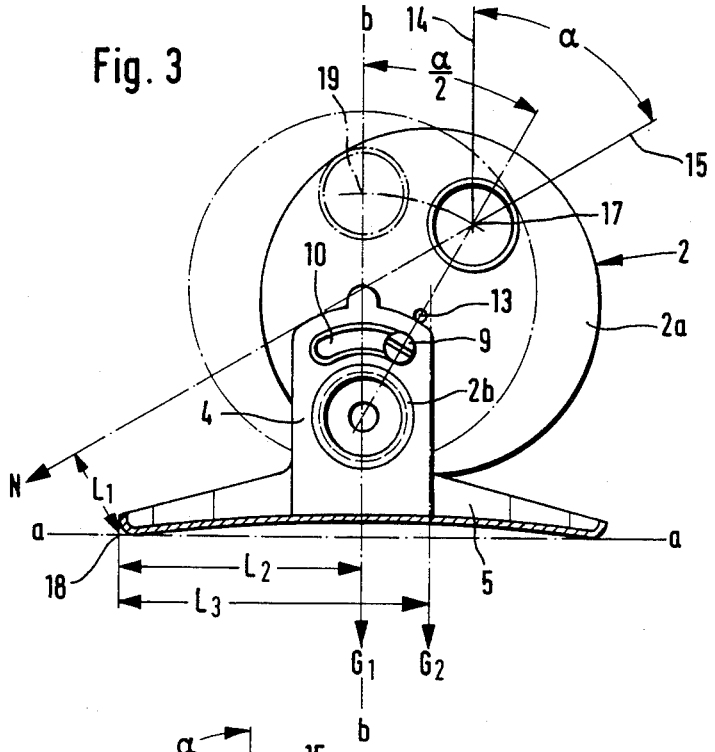
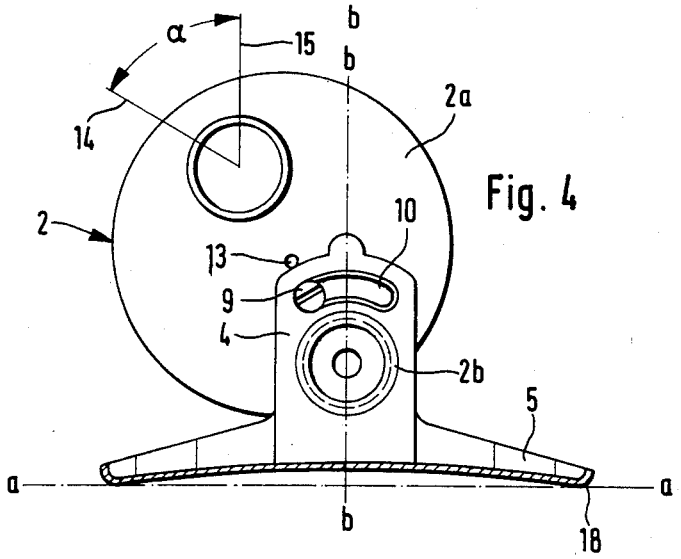
Fig. 4

ADJUSTABLE OSCILLATING FAN-JET SPRINKLER

BACKGROUND OF THE INVENTION

1. Field of the Invention

The present invention relates to irrigation sprinklers and, more particularly, to an oscillating fan-jet sprinkler of the type which has a slowly oscillating horizontal nozzle cylinder with a row of jet nozzles arranged in a fantail pattern and which uses a water-driven turbine to produce the oscillating motion of the nozzle cylinder.

2. Description of the Prior Art

Various oscillating sprinklers of the type mentioned above are known from the prior art. They have received widespread use as residential lawn sprinklers and for the irrigation of vegetable and flower beds, having the advantageous feature of covering an area of generally rectangular outline.

It is also known to arrange in the drive mechanism of the oscillating sprinkler means by which the oscillation range of the nozzle cylinder can be increased or decreased and shifted in relation to the supporting plane of the sprinkler. Such an adjustment mechanism is suggested in U.S. Pat. No. 2,914,255. This publication discloses an oscillating lawn sprinkler featuring an oscillation drive whose horizontal output shaft has a crank on its extremity with a connecting link attached by its distal extremity to an arcuately slotted control sector. Depending upon the point along the arcuate slot of the control section at which the connecting link is attached, the oscillation range of the spray tube or nozzle cylinder is relatively larger or smaller and shifted to one side or the other of the vertical center plane of the sprinkler. Thus, it is possible to increase or decrease the length of the area which is being covered, as well as to shift the location of that area in relation to the position of the sprinkler.

A related solution to the problem of oscillation range adjustability involves the attachment of the distal extremity of the connecting link to the drive sector on the oscillating nozzle cylinder by means of a rotatable eccentric attachment member which, depending upon its orientation in relation to the connecting link, increases or decreases the distance of the latter from the axis of the nozzle cylinder, as well as the angular drive relationship between the output shaft and the nozzle cylinder. The result of this adjustability is again an increase or decrease of the oscillation range, coupled with an angular shift of this range to one side or the other of a vertical center plane. This mechanism is disclosed in U.S. Pat. No. 4,245,786, for example.

Both prior art devices have the common shortcoming that the adjustability of the angular position of the oscillation range is immutably coupled with an increase or decrease of the oscillation range. Furthermore, the arrangement of the adjustment means as part of a crank drive makes it necessary to arrange the crank drive on the outside of the sprinkler housing. In the case of the eccentric attachment member, the device requires an adjustment know with inscriptions, such as "full", "partial", "right" and "left", without which it would be extremely difficult to set the proper adjustment, without repeated prior trial and error. The need for inscriptions, on the other hand, requires differently inscribed parts for markets in countries of different language.

SUMMARY OF THE INVENTION

Underlying the present invention is the primary objective of suggesting an improved oscillating fan-jet sprinkler of the type described above which offers an adjustability of the position of the oscillating range free of the shortcomings of the prior art devices.

The present invention proposes to attain this objective by suggesting an oscillating fan-jet sprinkler which features means for shifting the oscillation range of the nozzle cylinder by adjusting the angular relationship between the oscillation range and the sprinkler stand independently of the drive translation means, so that it is possible to shift the oscillation range without at the same time increasing or decreasing its angular extent. The oscillation drive may or may not include separate means for increasing or decreasing the oscillation range.

As part of the proposed oscillation range shifting means, the invention proposes a continuous angular adjustability in combination with position securing means for the maintenance of any adjusted position. The preferred oscillation range shifting means includes adjustment stops which determine the angular limits of the adjustment range in such a way that, in either adjustment extreme, one of the two oscillatory end positions of the spray plane is oriented substantially vertical, i.e. perpendicular to the supporting plane of the sprinkler stand and that, in a median adjustment position, the oscillation range covers an angle whose bisector is likewise vertical, i.e. perpendicular to the supporting plane of the sprinkler stand. The median adjustment position is preferably maintained by means of a detent.

A preferred embodiment of the invention has, as part of its oscillation range shifting means, a rotational connection between the sprinkler housing and an upwardly extending housing support of the sprinkler base, the rotational connection defining an adjustment axis which is either parallel to, or coincident with, the axis of the nozzle cylinder. As a result, the oscillation range of the nozzle cylinder is shiftable by adjusting the angular position of the sprinkler housing, which carries the nozzle cylinder, in its rotational connection to the housing support, the adjusted position being maintained by suitable position securing means. The latter may be in the form of a clamping screw which is preferably tightened only so much that forcible manual adjustment is possible without release of the screw.

The rotational connection between the sprinkler housing and the housing support may be combined with the inlet connection for the water supply, in the form of a hollow trunnion of the sprinkler housing which engages a matching bore of the housing support and into which is screwed a hose connector. In this case, the rotational connection is arranged vertically below the nozzle cylinder. Alternatively, it is possible to arrange the hollow trunnion of the sprinkler housing in a concentric relationship with the nozzle cylinder, the latter being journalled inside the hollow trunnion. In this case, the hose connector is preferably arranged on the axially opposite side of the sprinkler housing.

Another preferred embodiment of the invention features, as part of the oscillation range shifting means, a nozzle cylinder which is constituted of an oscillating sleeve journalled in the sprinkler housing and connected to the oscillation drive and a cylinder portion which is engaged over the oscillating sleeve, forming an angularly adjustable rotational connection in conjunction with suitable position securing means, adjustment stops, and a detent for the median position.

Among the advantages of the proposed improvement are the ease and the continuity of its adjustability and the possibility of readily ascertaining, by visual inspection, the actually adjusted angular position of the oscillation range, without the need for special markings or inscriptions. The arrangement of the oscillation range shifting means independently of the oscillation drive makes it possible to completely enclose the oscillation drive within the sprinkler housing. The arrangement of the rotational connection between the sprinkler housing and the sprinkler stand below the center of gravity of the combined sprinkler housing and nozzle cylinder further has the advantage of shifting the center of gravity inwardly from that edge of the sprinkler stand which determines the stability of the sprinkler in the lowest inclined position of the spray plane.

BRIEF DESCRIPTION OF THE DRAWINGS

Further special features and advantages of the invention will become apparent from the description following below, when taken together with the accompanying drawings which illustrate, by way of example, embodiments of the invention which are represented in the various figures as follows:

FIG. 3 is similar to FIG. 2, showing the oscillation range shifting means in a position adjusted towards the extreme right;

FIG. 4 is likewise similar to FIG. 2, showing the oscillation range shifting means in a position adjusted toward the extreme left;

DESCRIPTION OF THE PREFERRED EMBODIMENTS

Figure 1:
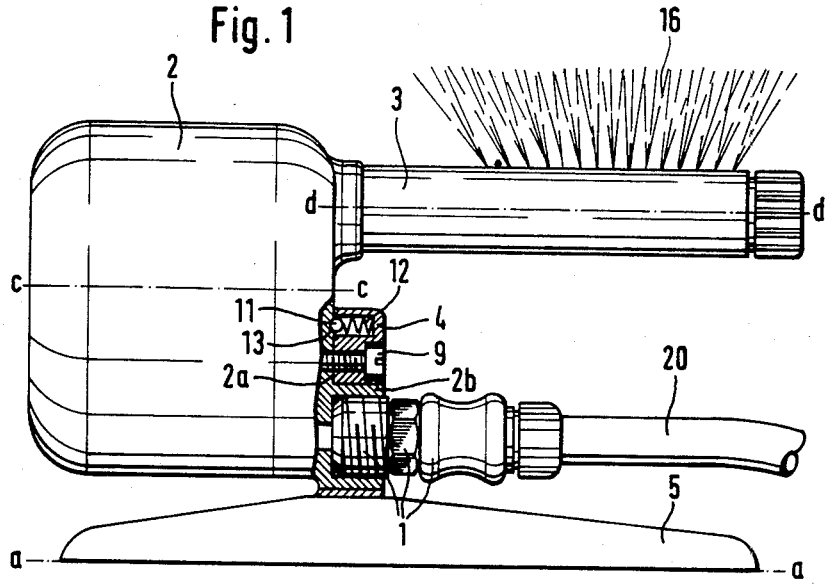
FIG. 1 shows, in elevation, an oscillating fan-jet sprinkler with a first embodiment of the oscillation range shifting means of the invention.
Figure 2:
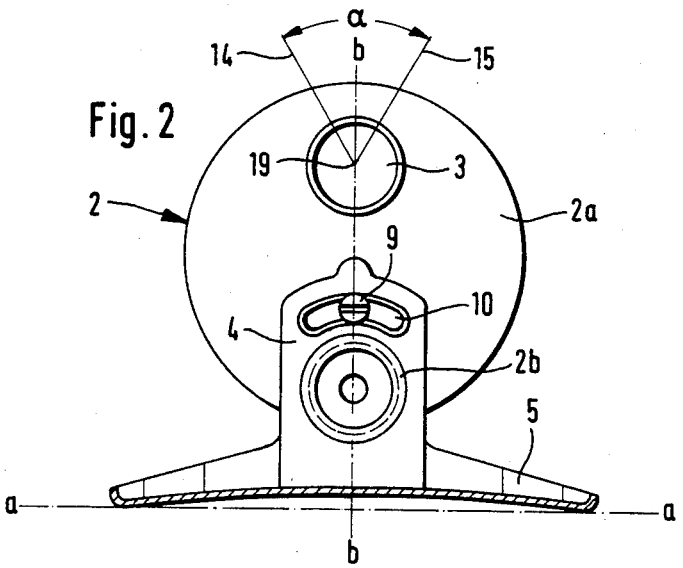
FIG. 2 shows the fan-jet sprinkler of FIG. 1 in a side view, the oscillation range shifting means being adjusted for a median position.
Figure 5:
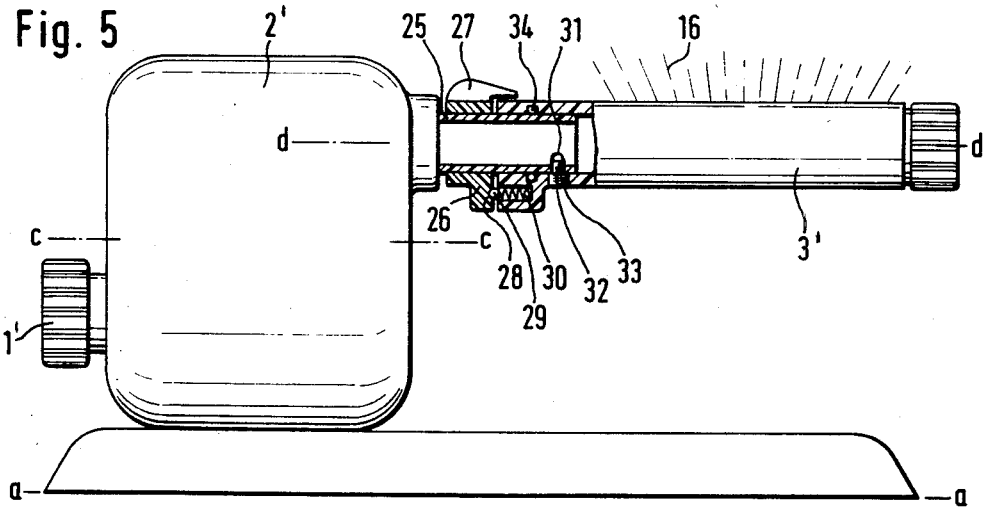
FIG. 5 shows, in elevation, an oscillating fan-jet sprinkler with a second embodiment of the oscillation range shifting means of the invention.
Figure 6:
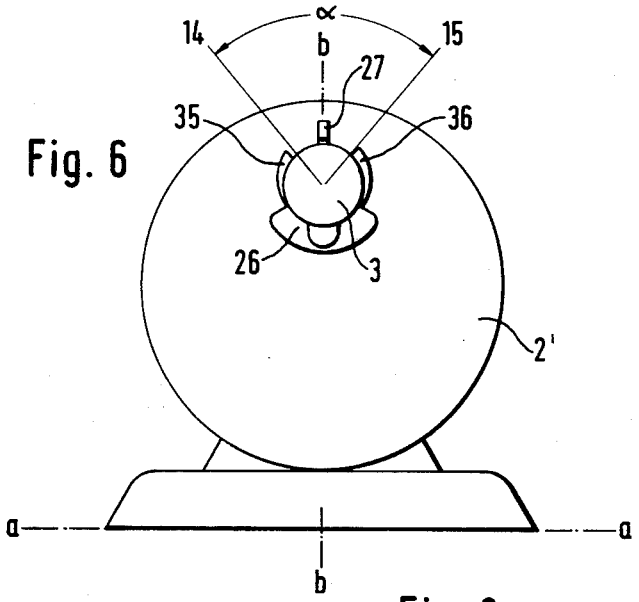
FIG. 6 shows the fan-jet sprinkler of FIG. 5 in a side view, the oscillating range shifting means being adjusted for a median position.

A first embodiment of the invention is illustrated in FIGS. 1 through 4. The oscillating fan-jet sprinkler of FIG. 1 consists essentially of a sprinkler housing 2, a nozzle cylinder 3 which is journalled in the housing 2, and a sprinkler stand 5 which supports the sprinkler housing 2. The sprinkler stand 5 normally rests on a horizontal supporting plane a—a, so that the oscillation axis d—d of the nozzle cylinder 3 is likewise horizontal. From the front wall 2*a* of the sprinkler housing 2 extends a hollow trunnion 2*b* with a female thread for the threaded attachment of a hose connector 1 to which is attachable a garden hose 20, for example, which supplies pressurized water to the sprinkler.

Inside the sprinkler housing 2 is arranged a water-driven turbine and a reduction gear (not shown), preferably of the worm-gear type, including drive translation means for the conversion of the rotary motion of the turbine wheel into a slow oscillatory motion of the nozzle cylinder 3. The latter has on its upper side a row of nozzle bores which are arranged in a fantail pattern so as to produce an oscillating curtain of water jets 16 which delivers water to a substantially rectangular area.

The sprinkler housing 2 which carries the nozzle cylinder 3 in a cantilever fashion is itself supported by the sprinkler stand 5 which has a vertically extending housing support 4 with a horizontal bore receiving the hollow trunnion 2*b* of the sprinkler housing 2, thus forming a rotational connection with an adjustment axis which is parallel to the oscillation axis d—d of the nozzle cylinder 3. About this adjustment axis, the sprinkler housing 2 is tiltable from its median position, shown in FIG. 2, to the right side or to the left side thereof, as shown in FIG. 3 and FIG. 4, respectively. A clamping screw 9, reaching through an arcuate slot 10 of the housing support 4 and engaging a threaded bore in the front wall 2*a* of the sprinkler housing 2, maintains the sprinkler housing in its adjusted position. The clamping screw 9 is preferably tightened only to such an extent that the friction between the housing support 4 and the housing front wall 2*a* is sufficient to maintain the adjusted position during sprinkling operation, but that it will yield to a manual adjustment force.

The median position of the sprinkler housing (FIG.2) is further secured by means of a detent device which consists of a bore in the housing support 4 holding a detent spring 12 and a detent ball 11 cooperating with a detent recess 13 in the housing front wall 2*a*.

The extent to which the oscillation range is shiftable in either direction from its median position is determined by the arcuate slot 10 and the clamping screw 9 which serves as a stop, when the screw abuts against an extremity of the slot 10. The length of the slot 10 is preferably such that the maximum adjustment in either direction equals one-half of the angle of the oscillation range, so that, in each extreme adjusted position, the higher one of the two end positions of the spray plane is vertical. Accordingly, when the oscillation axis d—d is tilted from the position 19 of FIG. 2 to the position 17 of FIG. 3, over an angle of $\alpha/2$, the left-hand angular end position 14 of the spray plane is vertical and the right-hand end position 15 is inclined at an angle $\alpha$. Similarly, when the housing 2 is tilted to the left, over the maximum adjustment angle $\alpha/2$, the right-hand angular end position 15 of the spray plane is vertical, and the left-hand angular end position 14 of the spray plane is inclined at an angle $\alpha$. In each case, only the area to one side of the sprinkler is covered by spray.

In addition to the greatly facilitated verification of the existing adjustment position and the ease of readjusting the position of the oscillation range, the present invention further offers the advantage of greater stability of the sprinkler against reaction forces from the fan-jet spray which would tend to overturn the sprinkler. This added stability can be readily ascertained from FIG. 3, for example, where it is shown that the fan-jet spray, in its angular end position 15, produces a reaction force N in the opposite direction. The stability of the sprinkler stand 5 is determined by the position of its outer longitudinal edge 18 in relation to the reaction force N and the counteracting total weight of the sprinkler.

FIG. 3 shows that the reaction force N produces an upsetting moment with a lever arm $L_1$. The upsetting moment is opposed by the sum of the stabilizing moments of the weight $G_1$ of the sprinkler stand 5 with the lever arm $L_2$ and of the combined weight $G_2$ of the sprinkler housing 2 and nozzle cylinder 3 with the lever arm $L_3$. The angular displacement of the sprinkler housing 2 not only decreases the lever arm of the reaction force N by the distance $L_4$, it also increases the lever arm of a major portion of the weight from $L_2$ to $L_3$. The fact that the hose connector 1 and the supply hose 20 are arranged underneath the nozzle cylinder 3 further contributes to the stability of the oscillating sprinkler.

From the foregoing description, it should be obvious that the position of the oscillation range can be readily adjusted during operation of the fan jet sprinkler and that the novel oscillation range shifting means allows for the adjustment of any angular position between the median position, in alignment with the vertical center plane B—B (FIG. 2) and either of the two extreme positions.

A second embodiment of the invention is illustrated in FIGS. 5 through 8. Here, the sprinkler 2' is fixedly attached to the sprinkler stand. The previous rotationally connection between these two parts is replaced by a rotational connection between two cooperating length portions of the nozzle cylinder, with the result that the oscillation axis d—d is also the adjustment axis. The modified nozzle cylinder consists of an oscillating sleeve 25 and a nozzle cylinder portion 3' which is engaged over an end portion of the oscillating sleeve 25. The latter is journalled in the sprinkler housing 2', taking the place of the journalled length portion of the nozzle cylinder 3 of FIG. 1. As in the previously described embodiment, the oscillating sleeve 25 is driven by a turbine wheel and a drive translation mechanism (not shown). Pressurized water is supplied to the sprinkler housing 2' through the hose connector 1' which, in this case, is located on the opposite axial side of the housing.

The oscillating sleeve 25 carries a yoke 26 with a radially extending adjustment stop 27 which cooperates with upstanding abutment shoulders 35 and 36 of the nozzle cylinder portion 3'. The latter is thus angularly adjustable in relation to the oscillating sleeve 29, the median adjustment position shown in FIG. 6 being maintained by a detent consisting of a detent spring 30, a detent ball 29 and a detent recess 28 in the yoke 26. In the axial sense, the nozzle cylinder portion 3' is secured in relation to the oscillating sleeve 25 by means of a radial screw 33 with a pin extension 32, the screw thread engaging the wall of the nozzle cylinder portion 3' and the pin extension 32 engaging an arcuate slot 31 in the oscillating sleeve 25.

Figure 7:
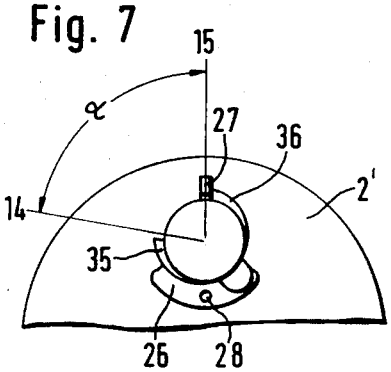
FIG. 7 shows the upper portion of FIG. 6, the oscillation range shifting means being adjusted to the extreme left-hand position.
Figure 8:
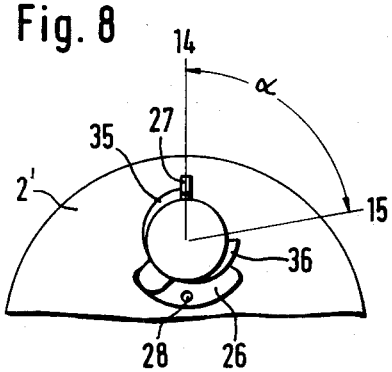
FIG. 8 is similar to FIG. 7, the oscillation range shifting means being adjusted to the extreme right-hand position.

The angular distance between the abutment shoulders 35 and 36 of the nozzle cylinder portion 3' determines the adjustment range of the nozzle cylinder portion 3' in relation to the oscillating sleeve 25. As in the previously described embodiment, this adjustment range is preferably identical to the oscillation range and symmetrical with respect to the vertical center plane b—b of the sprinkler. It follows that, in each extreme adjusted position of the oscillation range, one of the end positions 14 and 15 of the spray plane is oriented vertically, as can be seen in FIGS. 7 and 8.

In view of the arrangement of the rotational connection in conjunction with the nozzle cylinder itself, the maintenance of an adjustment position requires relatively little frictional force. The combined friction produced by the screw 33, under the action of spring 30, and the friction of an O-ring 34 serving as a seal between the oscillating sleeve 25 and the nozzle cylinder portion 3' is therefore sufficient for this purpose. Again, the oscillation range shifting means is operable during operation of the sprinkler, and adjustable to any angle within the adjustment range.

As a third embodiment of an oscillation range shifting means, the adjustable rotational connection can also be arranged between the vertical housing support 4 and the trunnion-like extension of the sprinkler housing inside which the nozzle cylinder is journalled. This modification necessitates the extension of the housing support 4 to the level of the nozzle cylinder 3 and the arrangement of the hose connector 1 at the axially opposite side of the sprinkler housing, as in the embodiment of FIG. 5. In this case, the clamping screw 9 and the detent mechanism 11–13 are arranged below the rotational connection. As a modification to the last-described embodiment, it is also possible to leave the vertical housing support 4 unchanged from the embodiment of FIG. 1 and to invert the sprinkler housing 2 in such a way that the nozzle cylinder 3 extends in the adjustment axis defined by the bore of the housing support 4.

While the nozzle cylinder is shown in the drawings to be a straight cylinder, it should be obvious that the latter could in all cases be replaced by a member which has an upwardly curving outline, for a row of nozzle openings which are radial with respect to the curved outline.

It should be understood, of course, that the foregoing disclosure describes only preferred embodiments of the invention and that it is intended to cover all changes and modifications of these examples of the invention which fall within the scope of the appended claims.

We claim the following:

1. An oscillating fan-jet sprinkler for the irrigation of a substantially rectangular area from a supply of pressurized water, the sprinkler having a housing with an inlet for pressurized water, a sprinkler stand supporting said housing while resting on a substantially horizontal supporting plane, an elongated nozzle cylinder extending from the sprinkler housing in a generally horizontal direction, the nozzle cylinder being journalled in said housing for oscillation about its longitudinal axis, a row of nozzle bores on the upper side of an exposed portion of the nozzle cylinder defining a fantail pattern of spray jets within a spray plane, and oscillation drive means including a turbine wheel inside the sprinkler housing driven by the incoming pressurized water and drive translation means converting the rotary motion of the turbine wheel into a slow oscillatory motion of the nozzle cylinder, the improvement therein comprising:

means for angularly shifting the oscillation range of the nozzle cylinder by angularly adjusting the structural relationship between the nozzle cylinder and the sprinkler stand independently of the oscillation drive and of the drive translation means, the oscillation range shifting means including:

a housing support as part of the sprinkler stand, the sprinkler housing being releasably attached to the housing support by securing means; and a rotational connection between the sprinkler housing and the housing support defining an adjustment axis which is parallel to the axis of the nozzle cylinder, the oscillation range of the nozzle cylinder being shiftable by adjusting the angular position of the sprinkler housing in its rotational connection to the housing support.

2. A sprinkler improvement as defined in claim 1, wherein the oscillation range shifting means is adapted for substantially continuous angular adjustments, comprising securing means for maintaining any adjusted position.

3. A sprinkler improvement as defined in claim 1, wherein the oscillation range shifting means is adapted for adjustments within an adjustment range extending over substantially equal angles in both directions from a median position of the oscillation range in which the bisector of its angle is perpendicular to the supporting plane of the sprinkler stand.

4. A sprinkler improvement as defined in claim 3, wherein the oscillation range shifting means includes adjustment stops determining the angular limits of the adjustment range in such a way that, in either adjustment extreme, one of the two oscillatory end positions of the spray plane is oriented substantially perpendicular to the supporting plane of the sprinkler stand.

5. A sprinkler improvement as defined in claim 3, wherein the oscillation range shifting means includes a detent means which holds the adjusted position in at least said median position of the oscillation range.

6. A sprinkler improvement as defined in claim 1, wherein the rotational connection between the sprinkler housing and the housing support is so arranged that the adjustment axis is located vertically below the axis of the nozzle cylinder in its median adjustment position.

7. A sprinkler improvement as defined in claim 6, wherein the rotational connection between the sprinkler housing and the housing support includes a horizontal bore in the housing support and a matching hollow trunnion extending from the sprinkler housing; and the hollow trunnion of the sprinkler housing also serves as the inlet for pressurized water, having a thread for a hose connector.

* * * * *